US010448676B2

(12) United States Patent
Fraser et al.

(10) Patent No.: US 10,448,676 B2
(45) Date of Patent: Oct. 22, 2019

(54) EXERCISE GARMENT CONFIGURED TO BE WORN BY AN INFANT

(71) Applicants: Nat Fraser, Denver, CO (US); Laura Fraser, Denver, CO (US)

(72) Inventors: Nat Fraser, Denver, CO (US); Laura Fraser, Denver, CO (US)

( * ) Notice: Subject to any disclaimer, the term of this patent is extended or adjusted under 35 U.S.C. 154(b) by 146 days.

(21) Appl. No.: 15/586,042

(22) Filed: May 3, 2017

(65) Prior Publication Data

US 2017/0318866 A1 Nov. 9, 2017

Related U.S. Application Data

(60) Provisional application No. 62/331,519, filed on May 4, 2016.

(51) Int. Cl.

| | |
|---|---|
| ***A41B 13/04*** | (2006.01) |
| *A41F 5/00* | (2006.01) |
| *A41D 13/05* | (2006.01) |
| *A41D 11/00* | (2006.01) |
| *A41D 13/00* | (2006.01) |

(52) U.S. Cl.

CPC ..... *A41B 13/04* (2013.01); *A41D 11/00* (2013.01); *A41D 13/0007* (2013.01); *A41D 13/0518* (2013.01); *A41F 5/00* (2013.01)

(58) Field of Classification Search

CPC ..... A41D 13/0007; A41D 13/0518; A41D 11/00; A41B 13/04; A41F 5/00

USPC ..... 2/80, 114, 83

See application file for complete search history.

(56) References Cited

U.S. PATENT DOCUMENTS

| | | | | |
|---|---|---|---|---|
| 146,175 | A * | 1/1874 | Flynt | A41F 5/00 2/117 |
| 4,324,205 | A * | 4/1982 | Goldmacher | B60R 22/00 2/300 |
| 5,619,751 | A * | 4/1997 | Ray | A41D 13/00 2/102 |
| 6,073,280 | A * | 6/2000 | Farnum | A61F 5/03 128/876 |
| 6,836,902 | B2 * | 1/2005 | Marquez | A47D 13/046 2/69 |
| 9,015,880 | B1 * | 4/2015 | Cauthen | A61G 7/1038 5/83.1 |
| 9,271,889 | B2 * | 3/2016 | Binder | A61G 7/10 |
| 2009/0144876 | A1 * | 6/2009 | Pena | A41D 13/0007 2/102 |
| 2015/0196063 | A1 * | 7/2015 | Dougherty | A41D 13/0007 2/69 |
| 2016/0270456 | A1 * | 9/2016 | Mulindwa | A41D 13/0007 |

* cited by examiner

*Primary Examiner* — Khaled Annis
*Assistant Examiner* — Dakota Marin
(74) *Attorney, Agent, or Firm* — Pierson IP, PLLC

(57) ABSTRACT

Examples of the present disclosure are related to systems and methods for an exercise garment configured to be worn by an infant. Specifically, embodiments are related to a fitness routine incorporating a safety harness to be worn by an infant.

4 Claims, 4 Drawing Sheets

EXERCISE GARMENT CONFIGURED TO BE WORN BY AN INFANT

BACKGROUND INFORMATION

Field of the Disclosure

Examples of the present disclosure are related to systems and methods for an exercise garment configured to be worn by an infant. Specifically, embodiments are related to a fitness routine incorporating a safety harness to be worn by an infant.

Background

Being a parent is a time-intensive and exhausting endeavor. Infants require near constant attention, which in turn occupies much of a parent's free time. Due to the decrease in free time, many parents find it difficult to maintain a consistent fitness routine while being fully involved with the infant.

Conventionally, parents may attempt to work out in the morning before work. However, due to an infant's inconsistent sleeping patterns, many parents are unable to perform a fitness routine at set periods before work. Alternatively, parents may attempt to work out in the afternoon after work. Yet, after being apart from their infant, parents may desire to skip working out in exchange for spending more time with their family. Thus, it is an arduous task for parents staying in shape with a newborn infant while interacting with their family.

Accordingly, needs exist for more efficient and effective systems and methods for a fitness routine for a parent incorporating an infant, wherein the fitness routine utilizes a garment configured to be worn by the infant.

SUMMARY

Embodiments disclosed herein describe systems and methods for a fitness routine for a parent incorporating an infant, wherein the fitness routine utilizes a garment configured to be worn by the infant. In embodiments, the garment may be comprised of a fabric portion and handle portions.

The fabric portion may include a torso orifice, a first leg orifice, and a second leg orifice. The torso orifice may be configured to encompass the upper torso of the infant, and the first leg orifice may be configured to receive a first leg of the infant, and the second leg orifice may be configured to receive a second leg of the infant.

The handle portions may be positioned on a first side and a second side of the fabric. In embodiments, a first handle may be positioned between the torso orifice and an upper end of the first leg orifice, and a second handle may be positioned between the torso orifice and an upper end of the first leg orifice.

In embodiments, the garment may incorporate two straps of material that are stitched tighter using horizontal, diagonal, and vertical stitches to form a "plus" sign, wherein the two straps intersect each other to form four ninety degree angles. The two straps may then be partially sewn onto a middle of the fabric portion. The middle of each of the straps may be initially sewn into a middle portion of the fabric towards the outer boundaries of the fabric such that an excess portion of the straps extend past the outer boundary of the fabric portion.

Next, the fabric portion may be folded in half with a crease running diagonally through the middle of the intersection of the two straps so that the excess portions of the straps align sandwiched inside of the folded material. The fabric portion may then be stitched together at each side, perpendicular to the crease. Extra material from the fabric portion may then be removed. The fabric portion may then be turned "inside out" such that the two straps are again on the outside of the fabric portion.

In embodiments, the corners of the fabric portion along the crease may be removed to create the first leg orifice and the second leg orifice. The diagonal straps may then be sewn into the fabric portion around each leg orifice, intersecting alongside the seams on the sides of each orifice. The straps may then be stitched together over the seam, using the same horizontal, diagonal, and vertical stitching with the loose ends still free.

The two loose ends of the straps on each side of the fabric portion may then then be threaded through a hollow rubber grip, be aligned with the seam of the fabric portion, and crisscrossed and stitched on top of the seam so the straps are firmly attached on both sides of the seam, which may also form handles. The fabric portion may then be hemmed above the handles to create the torso orifice. The strap ends may then be stitched over the hemmed torso orifice, with one end anchored into the fabric portion on each side of the seam.

To this end, utilizing two continuous straps that intersect underneath the infant's posterior when the infant is wearing the garment and above and below each handle, the garment will have structural integrity. More so, when a parent lifts the infant via the handles of the garment, the straps receive the weight of the infant through the infant's thighs and posterior. Additionally, the stitching of the handles onto the fabric portion affixes the straps to the material across and on both sides of the seam holding the sides of the fabric portion together. This may serve to reinforce the seams themselves, and spreads the gravitation force of the baby through the straps instead of pulling apart at the seam.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present embodiments are described with reference to the following figures, wherein like reference numerals refer to like parts throughout the various views unless otherwise specified.

Figure 1:
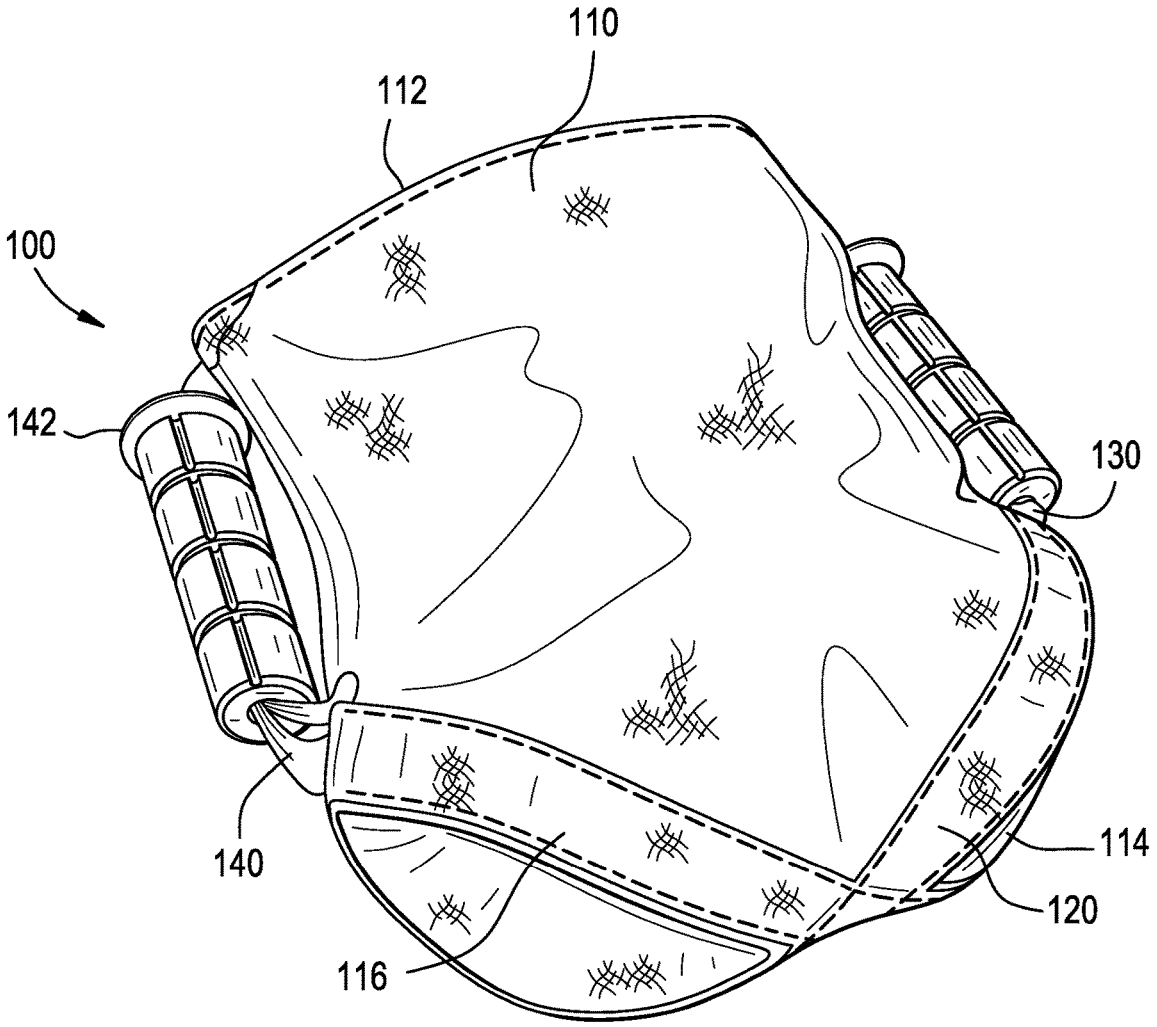
FIG. 1 depicts a garment configured to be worn by an infant, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Turning now to FIG. 1, FIG. 1 depicts a garment 100 configured to be worn by an infant, according to an embodiment. Garment 100 may be configured to allow a parent to safely utilize the body weight of the infant wearing garment 100 while performing an exercise routine. This allows a parent to interact with their infant while exercising. Garment 100 may include a fabric portion 110, straps 120, first handle 130, and second handle 140.

Fabric portion 110 may be a base formed of a unity piece of fabric, comprised of heavy duty canvas, vinyl, leather, or any other durable fabric material. Fabric portion 110 may initially have a width of twenty four inches and a length of twelve inches, or any other rectangular piece of fabric. Fabric portion 110 may have an inner surface that is configured to be positioned against an infant's skin, and an outer surface positioned away from the infant's skin. Fabric portion 110 may include a torso orifice 112, a first leg orifice 114, and a second leg orifice 116. Each of the orifices may have a fixed circumference and/or an adjustable circumference. Torso orifice 112 may be configured to encompass a torso of the infant, first leg orifice 114 may be configured to receive a first leg of the infant, and second leg orifice 116 may be configured to receive a second leg of the infant. Leg orifices 114, 116 may be angled orifices that are configured to extend upward from an intersection point of straps 120 towards handles 140.

Straps 120 may be configured to be coupled to fabric portion 110 via sewing, stitching, etc. Straps 120 may be comprised of canvas, cloth woven fabric, etc. Embodiments may include two straps of equal length that are approximately twenty eight inches in length. Straps 120 may be configured to distribute the force of a weight of an infant to handles 140 when the infant is being lifted. A center portion of straps 120 may be configured to intersect each other to form four ninety degree angles at the crotch of garment 100, which may be positioned adjacent to circumferences of leg orifices 114, 116.

Straps 120 may also be configured to form handles 140 by stitching a first portion of straps 120 adjacent to above first leg orifice 114 or second leg office 116, and a second portion of straps 120 onto a top of a seam adjacent to torso orifice 112 and above first leg orifice 114 or second leg office 116. Handles 140 may be configured to extend in a direction substantially perpendicular to torso orifice 112. By stitching two portions of straps 120 into fabric portion 120, a portion of straps 120 may be configured to move freely away from the edges of fabric portion 110. The straps 120 may then be stitched over the hemmed torso orifice 112, with one end anchored into the fabric portion on each side of the seam. In implementations before stitching the ends of straps 120 over the hemmed torso, straps 120 may be threaded through a hollow rubber grip 142. While in use, an adult may grab the grips 142 by inserting their hands through handles 140 to raise and lower the infant.

Figure 2:
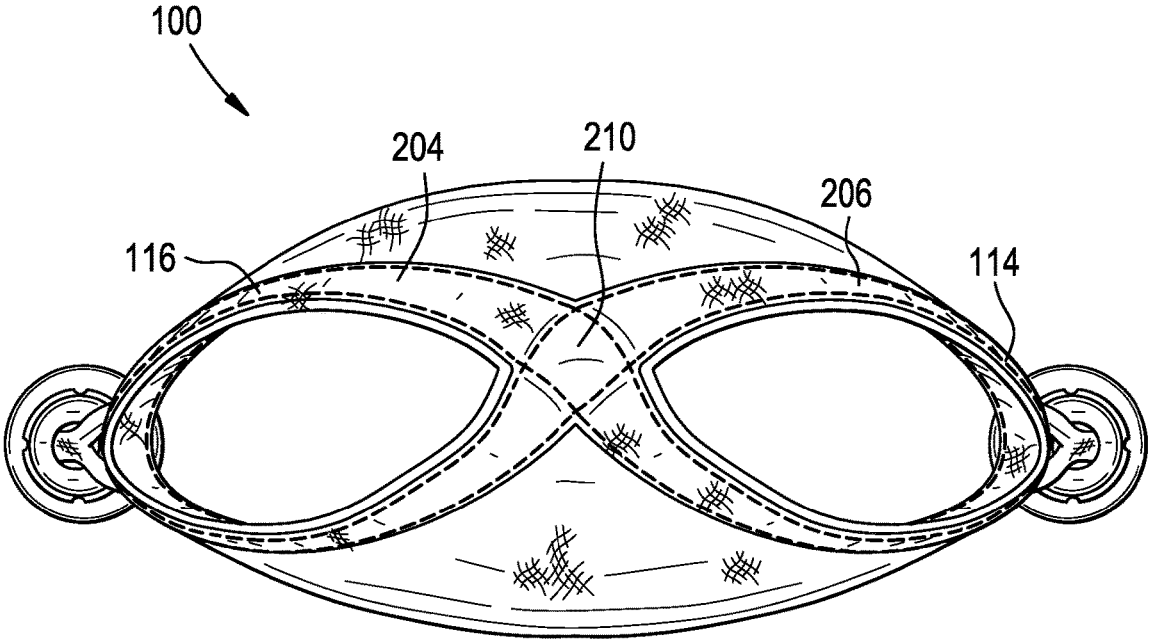
FIG. 2 depicts a bottom view of a garment configured to be worn by an infant, according to an embodiment.

FIG. 2 depicts a bottom view of garment 100 configured to be worn by an infant, according to an embodiment.

As depicted in FIG. 2, garment 100 may include a first strap 202 and a second strap 204. First strap 202 and second strap 204 may be configured to intersect at an intersection point 210 at a position between first leg orifice 114 and second leg orifice 116. First strap 202 and second strap 204 may be stitched tighter using horizontal, diagonal, and vertical stitches to form a "plus" sign, wherein the two straps intersect each other to form four ninety degree angles. The two straps 202, 204 may then be partially sewn onto a middle of the fabric portion at intersection point 210. The middle of each of the straps may be initially sewn into a middle portion of the fabric towards the outer boundaries of the fabric such that an excess portion of the straps extend past the outer boundary of the fabric portion. By overlaying straps 202, 204 at intersection point 210, forces applied to a first side of garment 100 may be transferred to a second side of garment 100.

Figure 3:
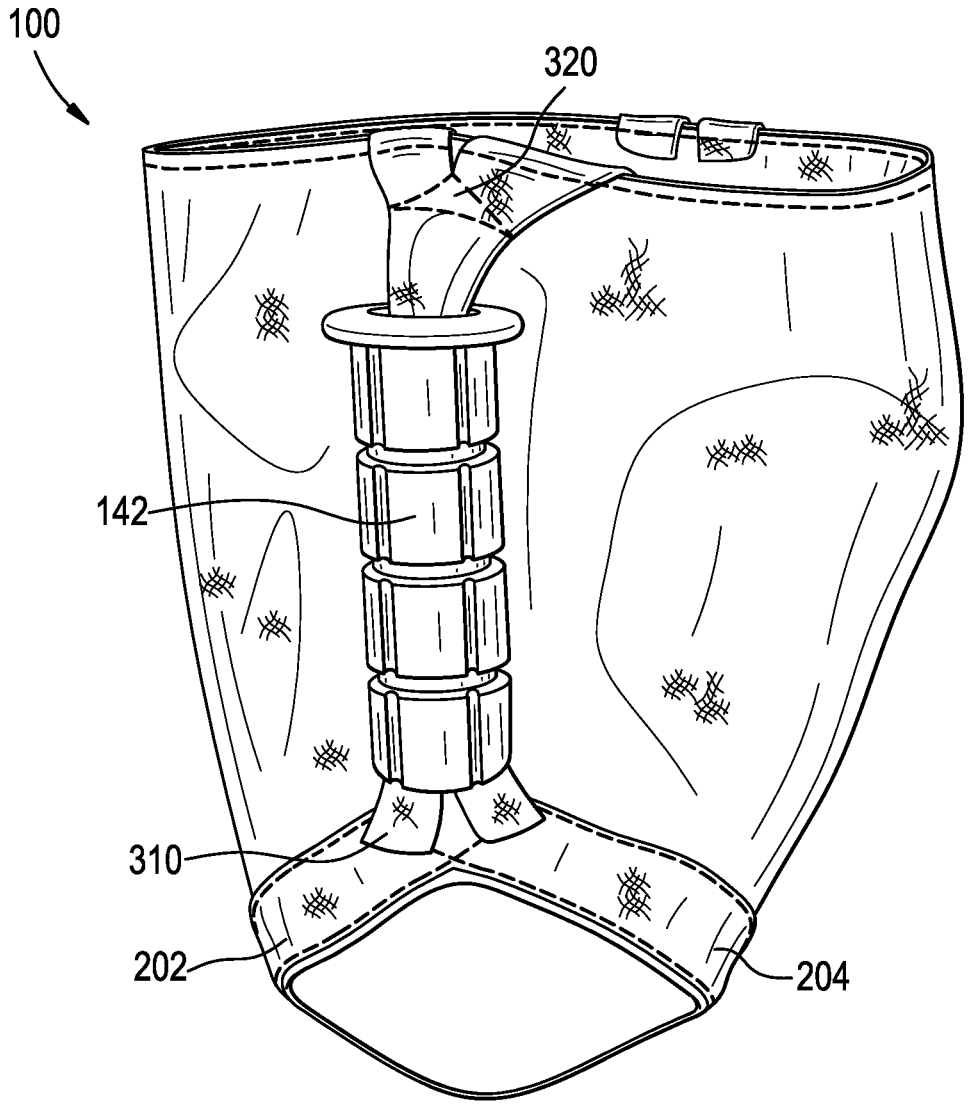
FIG. 3 depicts a side view of a garment configured to be worn by an infant, according to an embodiment.

FIG. 3 depicts a side view of garment 100 configured to be worn by an infant, according to an embodiment.

As depicted in FIG. 3, first strap 202 and second strap 204 may be configured to intersect 310 with one another at a position adjacent to an outer side of first leg orifice 114. First strap 202 and second strap 204 may be stitched tighter using horizontal, diagonal, and vertical stitches. After forming intersection 310, the extra lengths of straps 202, 204 may be inserted through rubber grip 142.

At the other side of rubber grip 142 and adjacent to the torso orifice aligned with the side of the fabric portion, first strap 202 and second strap 204 may be configured to intersection 320 with each other. First strap 202 and second strap 204 may be stitched tighter using horizontal, diagonal, and vertical stitches forming intersection 320. First ends of first strap 202 and second strap 204 may then be coupled to a first side of torso orifice 112. This process may be repeated for second leg orifice 116.

Figure 4:
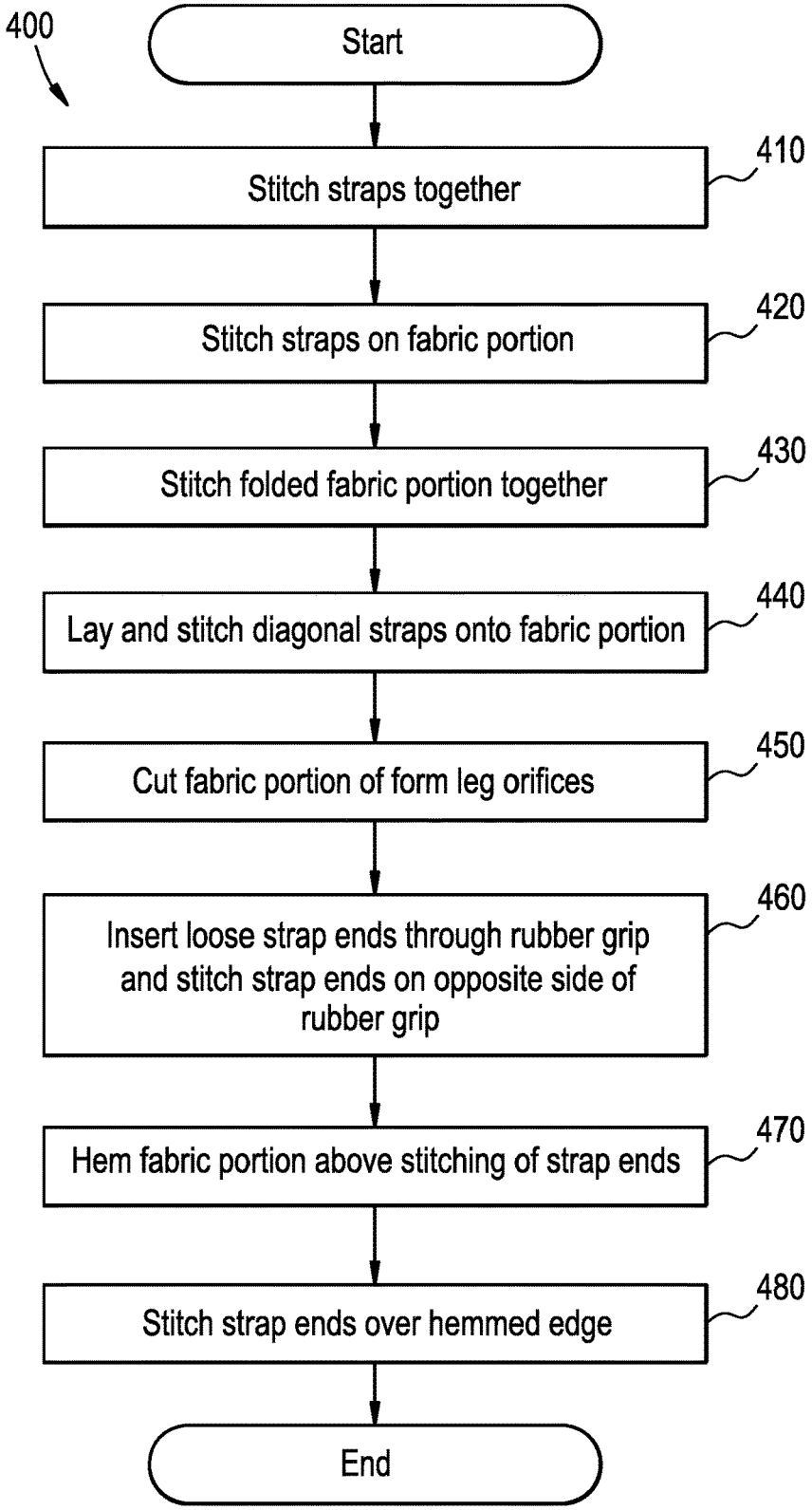
FIG. 4 depicts a method for forming a garment, according to an embodiment.

FIG. 4 illustrates a method 400 for forming a garment 100, according to an embodiment. The operations of method 400 presented below are intended to be illustrative. In some embodiments, method 400 may be accomplished with one or more additional operations not described, and/or without one or more of the operations discussed. Additionally, the order in which the operations of method 400 are illustrated in FIG. 4 and described below is not intended to be limiting.

At operation 410, two straps of material may be stitched tighter using horizontal, diagonal, and vertical stitches to form a "plus" sign, wherein the two straps intersect each other to form four ninety degree angles.

At operation 420, the two straps may then be partially sewn onto a middle of the fabric portion. The middle of each of the straps may be initially sewn into a middle portion of the fabric towards the outer boundaries of the fabric such that an excess portion of the straps extend past the outer boundary of the fabric portion.

At operation 430, the fabric portion may be folded in half with a crease running diagonally through the middle of the intersection of the two straps so that the excess portions of the straps align sandwiched inside of the folded material.

The fabric portion may then be stitched together along each side, perpendicular to the crease. Extra material from the fabric portion may then be removed. The fabric portion may then be turned "right side out" such that the straps are again on the outside of the fabric portion.

At operation 440, the diagonal straps may be positioned on top of the crease and stitched together in the same horizontal, diagonal, and vertical manner with the loose ends still free.

At operation 450, the corners of the fabric portion along the crease may be removed to create the first leg orifice and the second leg orifice. The diagonal straps may then be sewn to the fabric portion around each leg orifice, intersecting at the seams on the side of each orifice. The straps may then be stitched together over the seam, using the same horizontal, diagonal, and vertical stitching with the loose ends still free.

At operation 460, the two loose ends of the straps on each side of the fabric portion may then then be threaded through a hollow rubber grip, be aligned with the seam of the fabric portion, and crisscrossed and stitched on top of the seam so the straps are firmly attached on both sides of the seam, which may also form handles.

At operation 480, the fabric portion may then be hemmed above the handles to create the torso orifice.

At operation 490, the strap ends may then be stitched over the hemmed torso orifice, with one end anchored into the fabric portion on each side of the seam.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The flowcharts and block diagrams in the flow diagrams illustrate the architecture, functionality, and operation of possible implementations of systems and methods according to various embodiments of the present invention. It will also be noted that each block of the block diagrams and/or flowchart illustrations, and combinations of blocks in the block diagrams and/or flowchart illustrations, may be implemented in different orderings, combinations, etc., with additional blocks and/or blocks removed.

What is claimed is:

1. An infant garment configured to be worn by an infant, the infant garment comprising:

a base formed of a single piece of fabric;

a torso orifice configured to receive a torso of the infant, the torso orifice defining an upper edge of the infant garment, the torso orifice being positioned on a proximal end of the infant garment;

a first leg orifice configured to receive a first leg of the infant, the first leg orifice defining a first lower edge of the infant garment;

a second leg orifice configured to receive a second leg of the infant, the second leg orifice defining a second lower edge of the infant garment;

an intersection point positioned on the base, the intersection point being positioned between the first leg orifice and the second leg orifice on a crotch of the single piece of fabric, the intersection point being positioned at a distal most end of the infant garment;

a first strap;

a second strap, wherein the first strap and the second strap are positioned adjacent to circumferences of the first lower edge and the second lower edge, wherein the first strap and the second strap form a first handle positioned on a first side of the infant garment, and the first handle is positioned away from the base between the first location and the second location, and wherein the first strap and the second strap form a second handle positioned on a second side of the infant garment, wherein the torso orifice forms a permanently continuous border on the upper edge of the infant garment edge, the first strap and the second strap intersect at the intersection point on the crotch of the single piece of fabric, wherein the first strap is overlaid the second strap at the intersection point and are coupled together at the intersection point, the base including three orifices, the three orifices being the torso orifice, the first leg orifice, and the second leg orifice, wherein the first strap and the second strap run continuously along the circumferences of the first leg orifice and the second leg orifice.

2. The infant garment of claim 1, wherein the first strap and the second strap intersect each other to form four ninety degree angles at the distal end of the infant garment.

3. The infant garment of claim 2, further comprising:

a first grip configured to encompass the first handle;

a second grip configured to encompass the second handle.

4. The infant garment of claim 3, wherein the first strap extends through the first grip and the second grip, and the second strap extends through the first grip and the second grip.

* * * * *